US007731805B2

(12) United States Patent
Banta et al.

(10) Patent No.: US 7,731,805 B2
(45) Date of Patent: Jun. 8, 2010

(54) DISHWASHER RACK LIFT SYSTEM

(75) Inventors: Mark A. Banta, Crestwood, KY (US); Derek Watkins, Elizabethtown, KY (US); Ronald Tarr, Louisville, KY (US); Martin Mitchell Zentner, Prospect, KY (US); Sanjay Manohar Anikhindi, Karnataka (IN); Subhash Viswanathan Kollengode, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 805 days.

(21) Appl. No.: 11/606,733

(22) Filed: Nov. 30, 2006

(65) Prior Publication Data

US 2008/0129168 A1 Jun. 5, 2008

(51) Int. Cl.
*B08B 3/00* (2006.01)
*A47G 19/08* (2006.01)

(52) U.S. Cl. ..... 134/56 D; 211/41.8; 211/41.9; 312/319.3

(58) Field of Classification Search ..... 211/41.8; 134/56 D

See application file for complete search history.

(56) References Cited

U.S. PATENT DOCUMENTS

| | | | | |
|---|---|---|---|---|
| 2,822,229 | A * | 2/1958 | Carlson | 312/27 |
| 3,768,883 | A | 10/1973 | Kauffman | |
| 3,809,451 | A | 5/1974 | Pitstick | |
| 3,892,453 | A | 7/1975 | Daily | |
| 5,058,846 | A * | 10/1991 | Close | 248/284.1 |
| 5,115,822 | A | 5/1992 | Nichols | |
| 5,308,158 | A * | 5/1994 | Vogelgesang et al. | 312/319.3 |
| 5,462,347 | A * | 10/1995 | Vogelgesang et al. | 312/247 |
| 5,657,878 | A | 8/1997 | Austin | |
| 5,860,716 | A | 1/1999 | Good et al. | |
| 5,971,513 | A | 10/1999 | Cassalia | |
| 6,247,771 | B1 | 6/2001 | Miller | |
| 6,755,490 | B2 | 6/2004 | Welch et al. | |
| 7,168,578 | B2 | 1/2007 | Mersch et al. | |
| 2004/0118326 | A1 * | 6/2004 | Carpentier | 108/144.11 |
| 2006/0066189 | A1 * | 3/2006 | Bond et al. | 312/319.1 |
| 2007/0035220 | A1 * | 2/2007 | Bond et al. | 312/319.1 |

FOREIGN PATENT DOCUMENTS

EP 1508293 A1 * 2/2005

* cited by examiner

*Primary Examiner*—Michael Barr
*Assistant Examiner*—Charles W Kling
(74) *Attorney, Agent, or Firm*—George L. Rideout, Esq.; Armstrong Teasdale LLP

(57) ABSTRACT

A rack support system for a lower rack in a dishwasher is provided for a dishwasher having a wash chamber within a tub. The rack support system includes a frame configured to support the lower rack. A linkage system couples the frame to a side wall of the tub such that the lower rack is movable between a retracted position within the wash chamber and an extended position wherein the lower rack extends from the wash chamber. The lower rack is movable within a range between a lowered position and an elevated position with the lower rack extended from the wash chamber.

12 Claims, 7 Drawing Sheets

DISHWASHER RACK LIFT SYSTEM

BACKGROUND OF THE INVENTION

This invention relates generally to dishwashers and, more particularly, to a dishwasher and system for facilitating loading a lower rack of the dishwasher.

At least some known dishwashers include a cabinet, a tub within the cabinet that defines an open sided wash chamber, and a door assembly that seals the open side of the wash chamber when the dishwasher is in use. Soiled items, such as soiled dishes, glasses, utensils, and food and beverage containers, are loaded into the dishwasher tub through the open side of the wash chamber with the door open. A detergent is added, and after the door is closed, a dishwasher cycle may be executed to clean the items placed therein. The dishwasher may include a detergent dispenser that holds the detergent and releases the detergent at an appropriate time during the washing cycle. The wash chamber includes a sump portion that is configured to pump washing fluid from a fluid circulation assembly through spray arm conduits to wash items loaded into the wash chamber. The sump portion is further configured to collect wash fluid circulated throughout the wash chamber. The door assembly is attached to the dishwasher at a bottom end of the door and pivots about a hinge between an open position and a closed position.

Some known dishwashers include an upper rack and a lower rack that hold items to be washed. Typically, smaller items are placed in the upper rack while larger items are placed in the lower rack. In addition, the lower rack may also hold a basket for silverware and other utensils. Both the upper rack and the lower rack usually include a roller or slide system that permits the rack to be extended from the wash chamber for loading and unloading items.

Even though the racks may be extended from the wash chamber, the lower rack is positioned near the bottom of the wash chamber, and as a result, the operator must bend or stoop when loading and unloading the lower rack. This may be particularly cumbersome when loading larger items. The dishwasher would be more convenient to use if the lower rack could be positioned so that loading and unloading could be more easily accomplished.

BRIEF DESCRIPTION OF THE INVENTION

In one aspect, a rack support system for a lower rack in a dishwasher is provided. The dishwasher defines a wash chamber within a tub. The rack support system includes a frame configured to support the lower rack. A linkage system couples the frame to a side wall of the tub such that the lower rack is movable between a retracted position within the wash chamber and an extended position wherein the lower rack extends from the wash chamber. The lower rack is movable within a range between a lowered position and an elevated position with the lower rack extended from the wash chamber.

In another aspect, a dishwasher is provided. The dishwasher includes a cabinet and a tub mounted within the cabinet. The tub defines a wash chamber. A rack support is coupled to a side wall of the tub. A lower rack is supported by the rack support such that the lower rack is movable between a retracted position within the wash chamber and an extended position wherein the lower rack extends from the wash chamber. The lower rack is movable within a range between a lowered position and an elevated position with the lower rack extended from the wash chamber.

In another aspect, a method is provided for moving a lower rack in a dishwasher between a lowered position and a locked elevated position, wherein the dishwasher defines a wash chamber within a tub. The method includes operatively coupling a rack support system to the lower rack. The rack support system includes a frame configured to support the lower rack, and a linkage system coupling the frame to a sidewall of the tub. A lock-and-release mechanism of the rack support system includes a stop link forming a stop tab and a locking tab. The method further includes withdrawing the lower rack from the wash chamber to the lowered position, lifting upwardly on the lower rack to raise the lower rack such that a front link of the linkage system rotates with respect to a corresponding side member of the frame as the lower rack is raised, and engaging a stud on the front link with the locking tab to lock the lower rack in the elevated position.

DETAILED DESCRIPTION OF THE INVENTION

Figure 1:
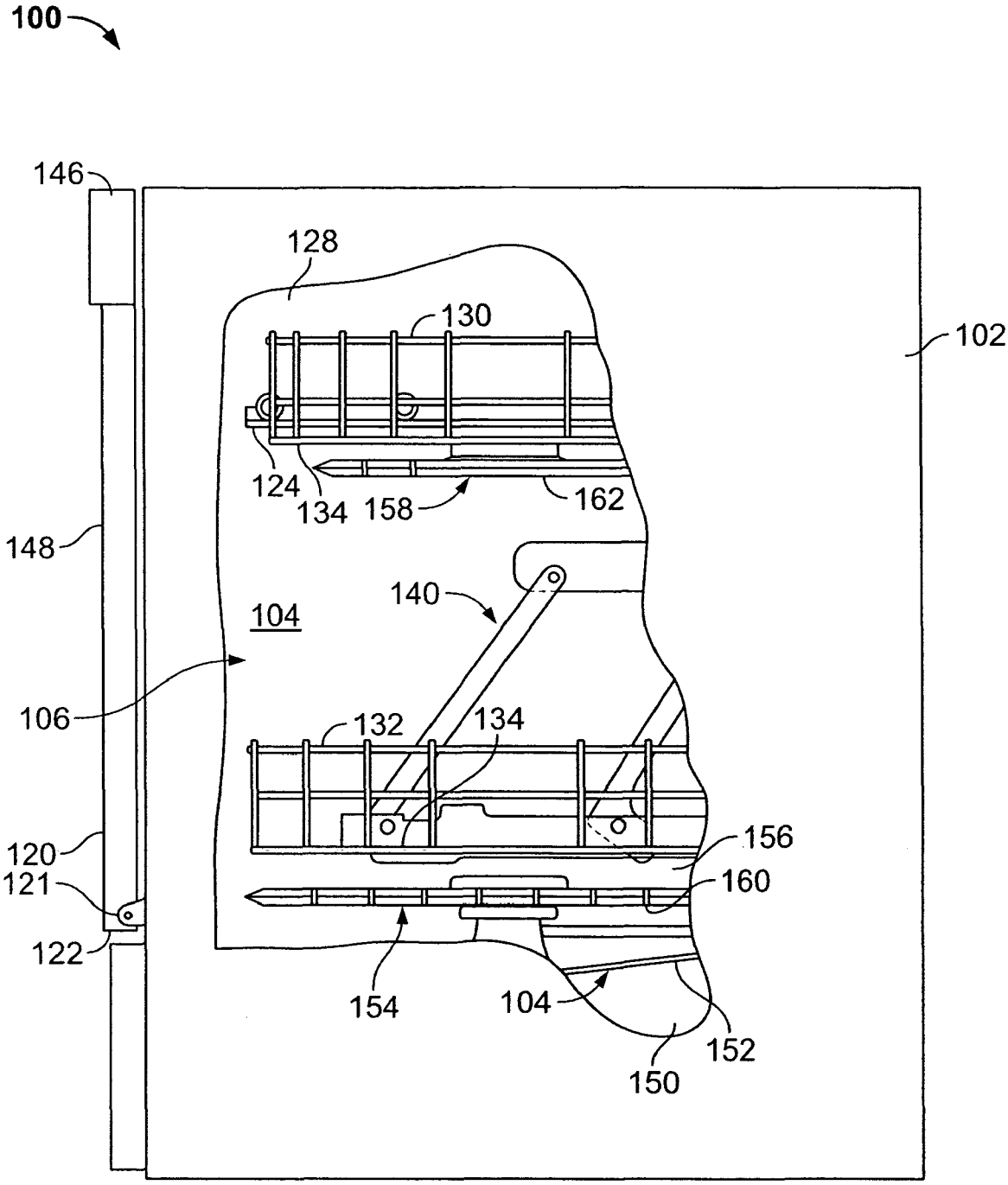
FIG. 1 is a side elevational view of an exemplary dishwasher system partially broken away.

FIG. 1 is a side elevational view of an exemplary domestic dishwasher system 100 partially broken away. It is contemplated, however, that the methods and apparatus herein described may be practiced in other types of dishwashers and dishwasher systems beyond dishwasher system 100 described and illustrated herein. Accordingly, the following description is for illustrative purposes only, and the methods and apparatus herein described is in no way limited to use in a particular application, or to a particular type of appliance, such as, for example, dishwasher system 100.

Dishwasher 100 includes a cabinet 102 having a tub 104 therein and forming a wash chamber 106. Tub 104 includes a front opening (not shown in FIG. 1) and a door assembly 120 pivotally attached by a hinge 121 at a bottom 122 for movement between a vertical closed position, as shown in FIG. 1, wherein wash chamber 106 is sealingly enclosed for washing operation, and a horizontal open position (not shown) for loading and unloading of dishwasher contents. An upper guide rail 124 is mounted on tub side walls 128 and accommodates an upper roller-equipped rack 130. Upper rack 130 and a lower roller-equipped rack 132 are fabricated from known materials into lattice structures including a plurality of elongate members 134, and each rack 130, 132 is adapted for movement between an extended loading position (not shown) in which the rack is substantially positioned outside wash chamber 106, and a retracted position (shown in FIG. 1) in which the rack is located inside wash chamber 106. In the exemplary embodiment, lower rack 132 is supported by a support system 140. Support system 140 is configured to allow for vertical movement of lower rack 132 from a lowered position to an elevated position when lower rack is extended from wash chamber 106, as described in greater detail below. A silverware basket (not shown) may be removably attached to lower rack 132 for placement of silverware, utensils, and the like that are too small to be accommodated by upper and/or lower racks 130, 132.

A control panel (not shown in FIG. 1) is integrated into an escutcheon 146 that is mounted to door assembly 120, or in further and/or alternative embodiments, a plurality of control selectors, (e.g., buttons, switches and/or knobs) and/or control displays are mounted at a convenient location on an outer face 148 of door assembly 120. The control panel and associated selectors and/or displays are coupled to known control circuitry (not shown) and control mechanisms (not shown) for operating a fluid circulation assembly (not shown) that circulates water and dishwasher fluid in dishwasher tub 104. The fluid circulation assembly is located in a machinery compartment 150 located below a bottom sump portion 152 of tub 104. The construction and operation of the fluid circulation assembly is well within the purview of those skilled in the art without detailed explanation, and further discussion of the fluid circulation assembly is therefore omitted.

A lower spray-arm-assembly 154 is rotatably mounted within a lower region 156 of wash chamber 106 and above tub sump portion 152 so as to rotate in relatively close proximity to lower rack 132. A mid-level spray-arm assembly 158 is located in an upper region of wash chamber 106 and is located in close proximity to upper rack 130 and at a sufficient height above lower rack 132 to accommodate a larger item, such as a dish or platter (not shown), placed in lower rack 132 and washed in dishwasher system 100. In another embodiment, an upper spray arm assembly (not shown) is located above upper rack 130 at a sufficient height to accommodate a taller item that can be placed in upper rack 130, such as a glass (not shown) of a selected height.

Lower and mid-level spray-arm assemblies 154, 158 and the upper spray arm assembly are fed by the fluid circulation assembly, and each spray-arm assembly includes an arrangement of discharge ports or orifices 160, 162, respectively, for directing washing liquid onto dishes located in upper and lower racks 130, 132, respectively. The arrangement of the discharge ports 160 in at least lower spray-arm assembly 154 provides a rotational force by virtue of washing fluid flowing through the discharge ports 160. The resultant rotation of lower spray-arm assembly 154 provides coverage of dishes and other dishwasher contents with a washing spray. In various alternative embodiments, mid-level spray arm 158 and/or the upper spray arm are also rotatably mounted and configured to generate a swirling spray pattern above and below upper rack 130 when the fluid circulation assembly is activated and door assembly 120 is properly closed to seal wash chamber 106 for operation.

Figure 2:
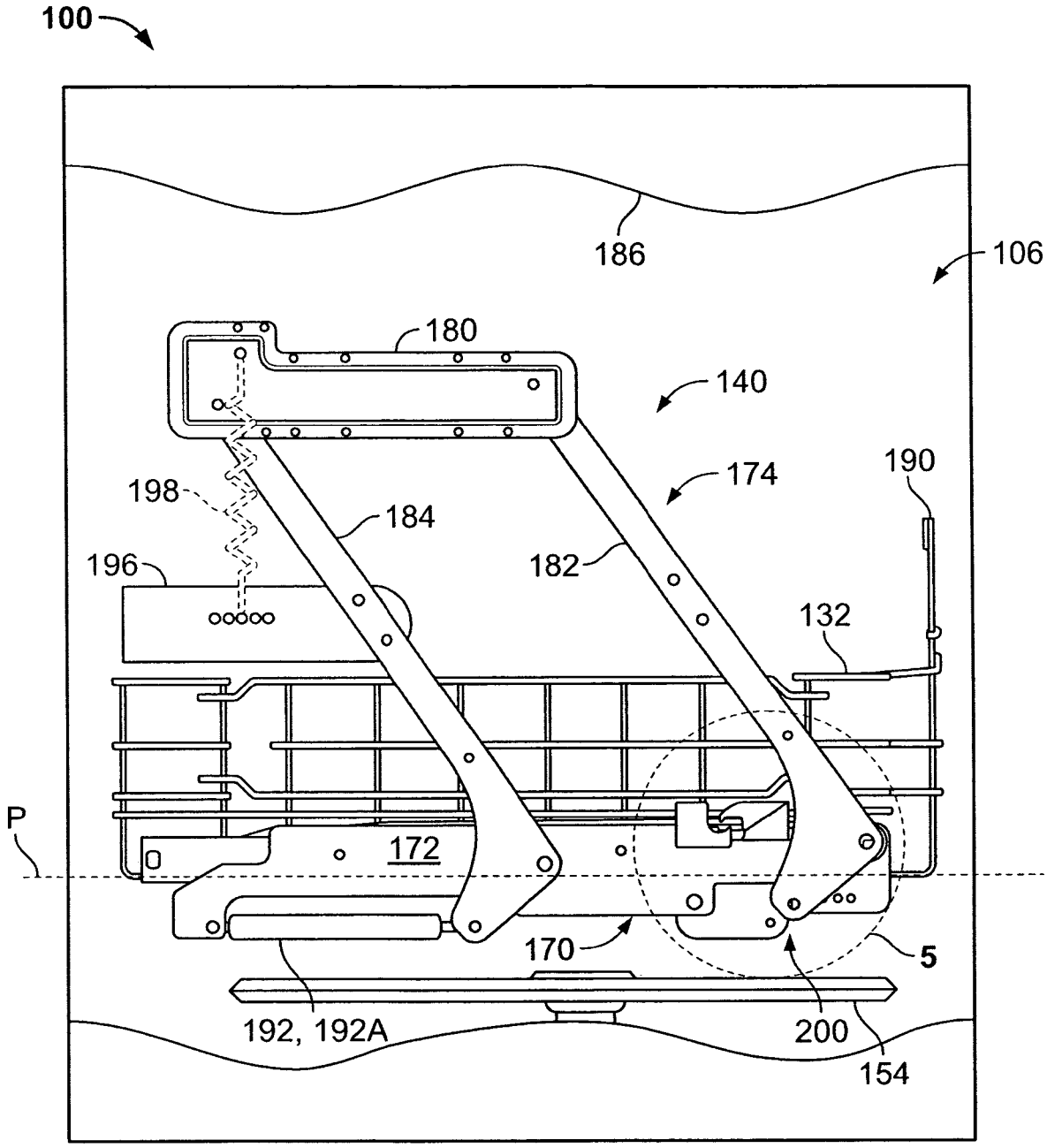
FIG. 2 is side elevational view of a lower rack and support system with the lower rack retracted into a wash chamber.
Figure 3:
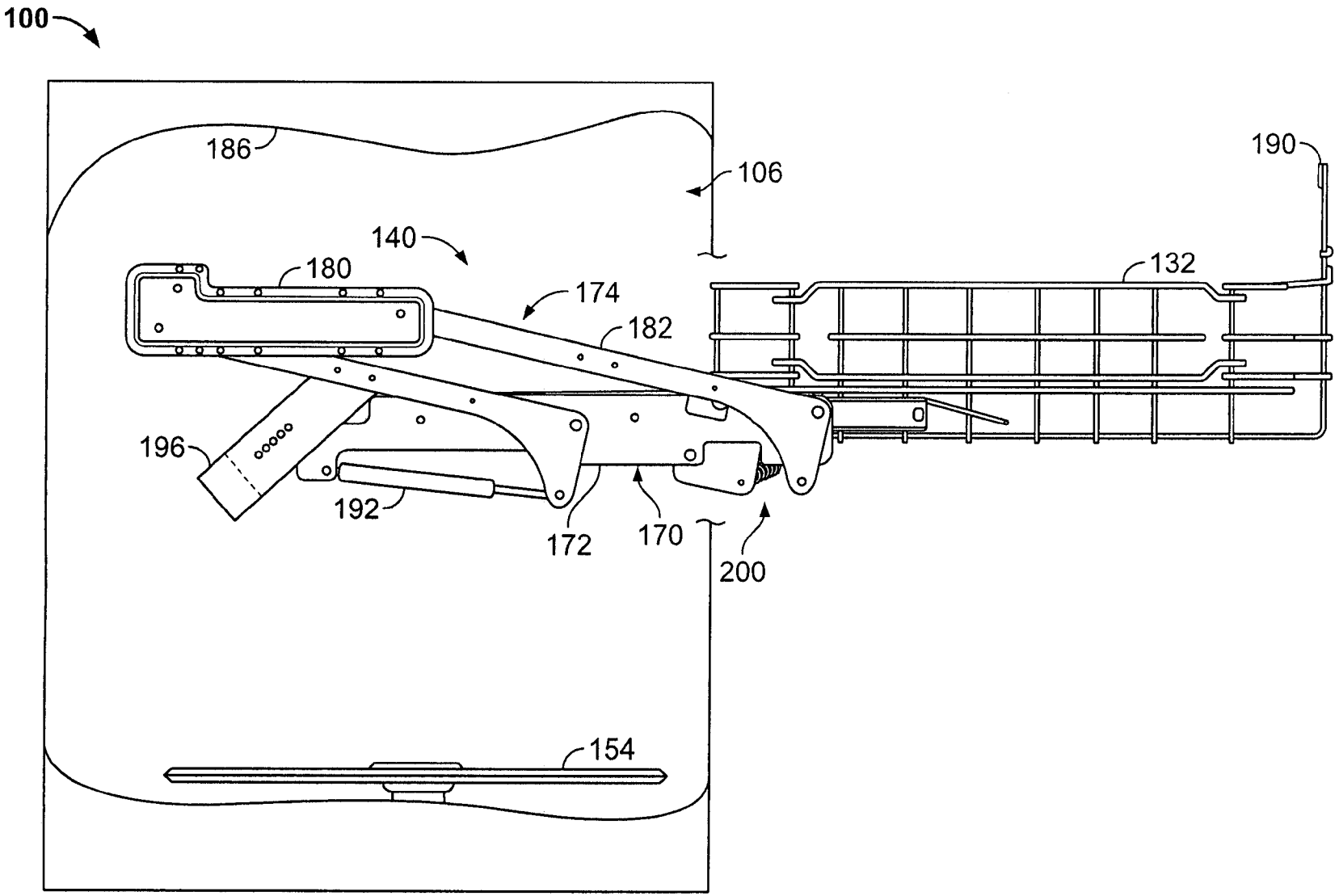
FIG. 3 is side elevational view of a lower rack and support system with the lower rack extended from the wash chamber and locked in a raised position.

FIG. 2 is side elevational view of lower rack 132 and support system 140 with lower rack 132 in a retracted position within wash chamber 106. FIG. 3 is side elevational view of lower rack 132 and support system 140 with lower rack 132 extended from wash chamber 106 and locked in a raised position. Support system 140 includes a frame 170 having side members 172 and a linkage system 174 on opposite sides of lower rack 132, only one of which is shown in FIGS. 2 and 3. Frame 170 holds and supports lower rack 132 in a plane indicated by phantom line P in FIG. 2. Linkage system 174 is a four bar linkage of which side member 172 of frame 170 is a part. In an exemplary embodiment, linkage system 174 includes a bracket 180, a front link 182, a rear link 184, and frame side member 172. Bracket 180 is coupled to a side wall 186 of tub 104 and is fixed with respect to tub 104. In FIGS. 2 and 3, side wall 186 is partially cut away to reveal lower rack 132 and support system 140. Front link 182 and rear link 184 are substantially parallel to one another.

When fully extended from wash chamber 106, lower rack 132 along with frame 170 is movable vertically within a range between a lowered position, as shown in FIG. 2, and an elevated position, as shown in FIG. 3. In the description that follows, it is to be understood that frame 170 and lower rack 132 move vertically in unison and references to vertical movement of either includes similar movement of the other. Front and rear links 182 and 184 remain substantially parallel to one another throughout the range of vertical movement of lower rack 132. Lower rack 132 may be raised to the elevated position by lifting upward on lower rack 132. In one embodiment, lower rack 132 is provided with a handle 190 to facilitate lifting of lower rack 132. Front and rear links 182 and 184, respectively, are pivotably connected to bracket 180 and frame side member 172 and have lengths sized between pivot points such that lower rack 132 remains parallel to plane P throughout its range of upward and downward movement. In alternative embodiments, bracket 180 may be omitted and front and rear links 182 and 184 may be pivotably coupled directly to tub side wall 186.

A biasing member 192 is provided to counterbalance the weight of the moving components of support system 140. In an exemplary embodiment, biasing member 192 is a gas spring. Alternatively, biasing member 192 may comprise an extension spring. In a further embodiment, a damper 192A is provided to dampen vertical movement of lower rack 132 to prevent or limit damage to items positioned in lower rack 132 if lower rack 132 is dropped. In the illustrated embodiment, biasing member 192 comprises a gas spring and damper combination. A stabilizing bar 196 interconnects linkage systems 174 on opposite sides of lower rack 132. Stabilizing bar 196 is provided to assure that linkage systems 174 move in unison throughout the full range of motion of linkage systems 174. In contrast to the previously described embodiments, a biasing member 198, shown in phantom in FIG. 2, may be positioned elsewhere in support system 140, such as between stabilizing bar 196 and bracket 180 or side wall 186. Similarly, damper 192A, which in the illustrated embodiment is interconnected between rear link 184 and side member 172, may be located elsewhere, such as between stabilizing bar 196 and bracket 180 or side wall 186.

Support system 140 further includes a lock-and-release mechanism 200 that is configured to lock linkage system 174, and consequently lower rack 132, in the elevated position shown in FIG. 3, as described in greater detail below.

Figure 4:
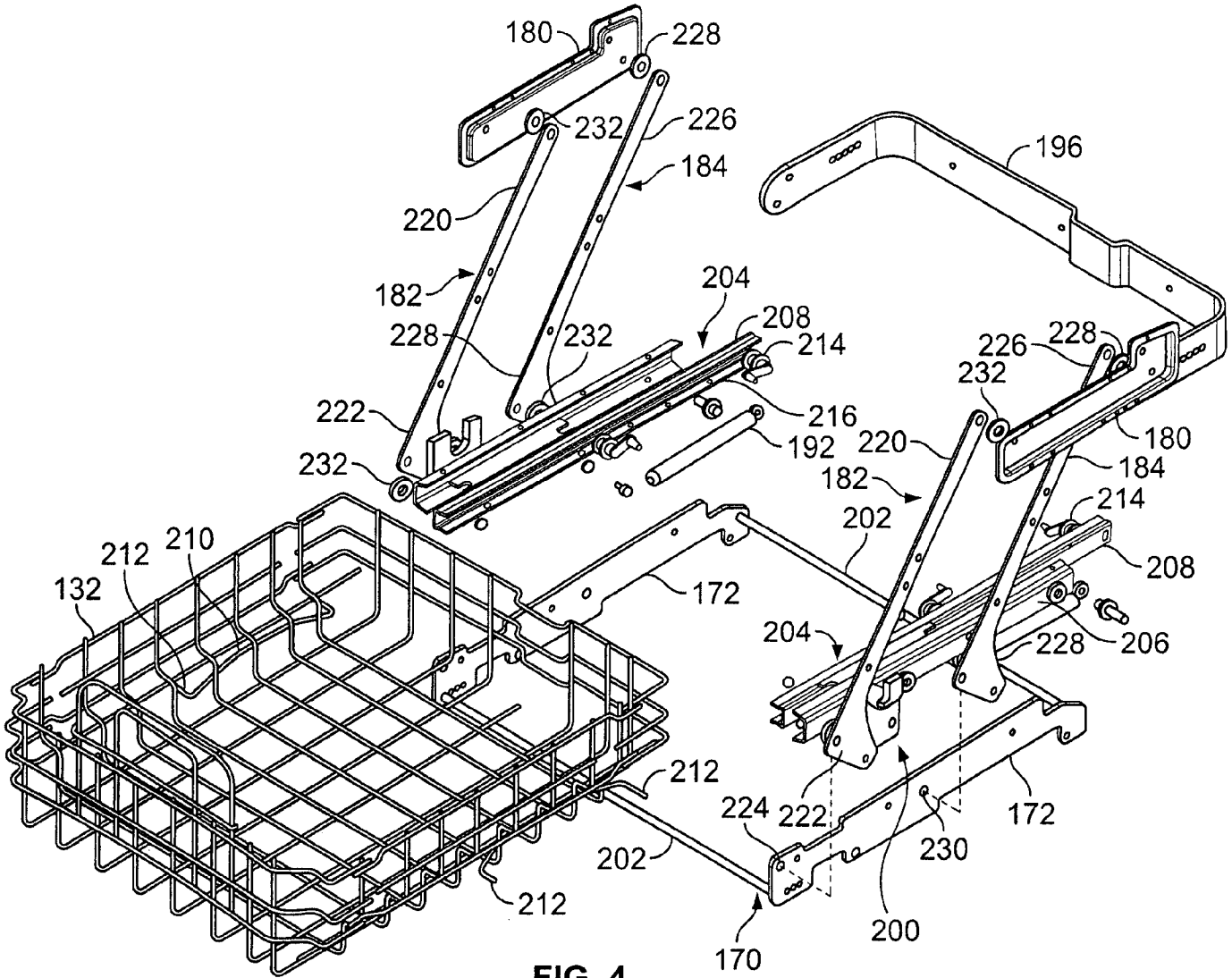
FIG. 4 is a partially exploded view of the rack and support system shown in FIGS. 2 and 3.

FIG. 4 is a partially exploded view of lower rack 132 and support system 140. Frame 170 includes spaced apart side members 172 and front and rear cross members 202 that interconnect side members 172. A slide mechanism 204 is coupled to each side member 172. Each slide mechanism 204 includes an outer rail 206 and an inner rail 208. Outer rail 206 is fixedly coupled to a corresponding side member 172. Inner rail 208 moves within outer rail 206. More specifically, inner rail 208 telescopes into and out of outer rail 206 with a ball bearing connection according to known methods. Lower rack 132 includes roller links 210 having ends 212 on which rollers 214 are mounted. Inner rail 208 includes an inwardly facing channel 216 sized to receive rollers 214 such that lower rack 132 is supported on inner rail 208 of slide mechanism 204. Inner rail 208 extends from outer rail 206 while lower rack 132 extends from inner rail 208 to enable lower rack 132 to fully extend from wash chamber 106.

Each front link 182 has an upper end 220 that is pivotably coupled to bracket 180 and a lower end 222 that is pivotably coupled to frame side member 172 at an attachment point 224. Similarly, each rear link 184 has an upper end 226 that is pivotably coupled to bracket 180 and a lower end 228 that is pivotably coupled to frame side member 172 at an attachment point 230. In an exemplary embodiment, washers 232 are provided at the upper and lower pivot connections of front and rear links 182 and 184 to reduce friction at the pivot connections. Washers 232 may be fabricated from TEFLON® or other known materials suitable for such applications.

Figure 5:
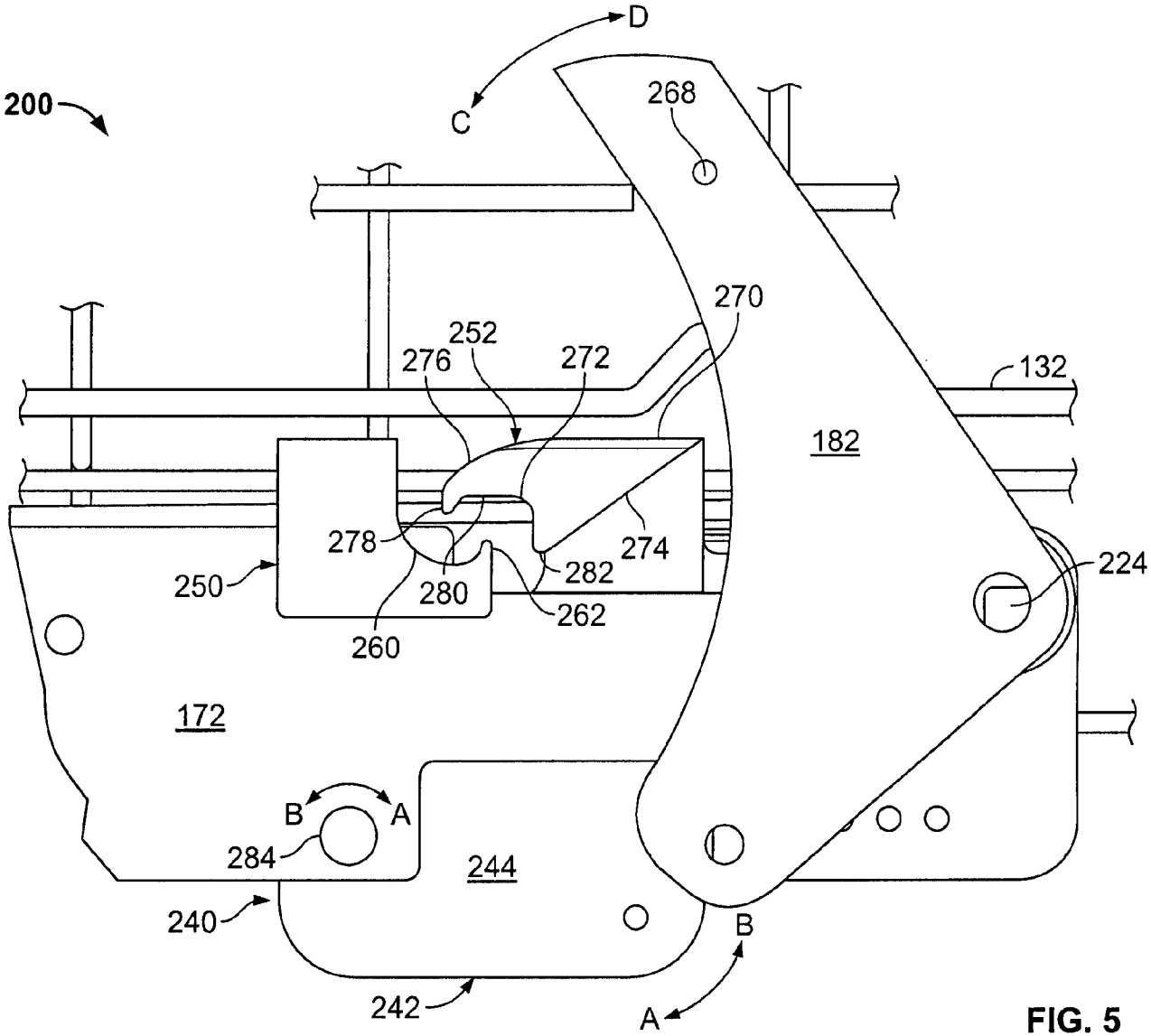
FIG. 5 is a side elevational view of a lock-and-release mechanism of the support system shown in FIG. 2, viewed from an outer side and positioned as shown in FIG. 2.
Figure 6:
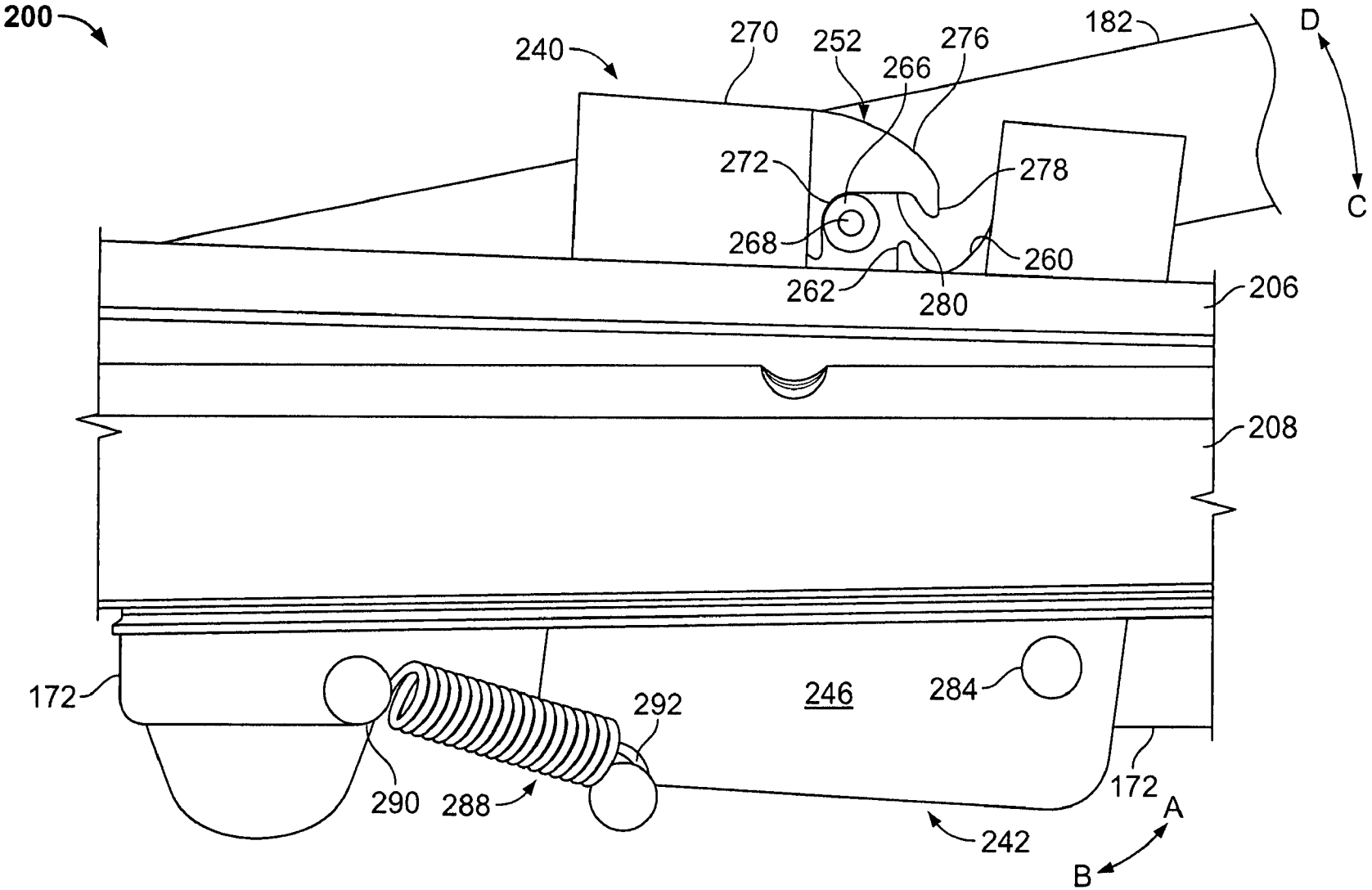
FIG. 6 is a side elevational view of the lock-and-release mechanism shown in FIG. 5 viewed from an inner side and positioned as shown in FIG. 3.

FIG. 5 is a side elevational view of lock-and-release mechanism 200 of rack support system 140 viewed from an outer side facing away from wash chamber 106 and positioned as shown in FIG. 2. FIG. 6 is a side elevational view of lock-and-release mechanism 200 viewed from an inner side facing wash chamber 106 and positioned as shown in FIG. 3. Lock-and-release mechanism 200 is configured to lock linkage system 174 along with frame 170 and therefore lower rack 132 in the elevated position and to release the linkage system 174, frame 170, and lower rack 132 from the locked condition allowing the aforementioned elements to be lowered. Lock-and-release mechanism 200 includes a stop link 240 having a main body 242 that has an outer side 244 that faces away from wash chamber 106 and an inner side 246 that faces toward wash chamber 106. In an exemplary embodiment, stop link 240 is a substantially flat rectangular planer plate with outer and inner sides 244 and 246 that are substantially parallel to one another. Main body 242 includes a stop tab 250 and a locking tab 252 both of which are integrally formed with main body 242 and include portions folded over main body 242.

Stop tab 250 includes an arcuate stop edge 260 that culminates with an upwardly extending tip 262. Stop edge 260 engages a stud 266 on front link 182 to limit upward movement of linkage 174 and lower rack 132 when lower rack 132 is being raised, as described in greater detail below. Stud 266 is fixedly attached to front link 182 at attachment point 268 shown in FIG. 6. Locking tab 252 includes an upper engagement surface 270, a locking pocket 272, and a release ramp 274. Locking pocket 272 is configured to receive and retain stud 266 on front link 182. Upper engagement surface 270 has an arcuate edge 276 that culminates in a tip 278 that projects over upwardly extending tip 262 on stop tab 250 and toward stop edge 260 on stop tab 250. A lower edge 280 extends from tip 278 to locking pocket 272. A lower release tip 282 joins locking pocket 272 with release ramp 274.

Main body 242 of stop link 240 is pivotably coupled to frame side member 172 at a pivot location 284 such that stop link 240 is pivotable in generally opposing directions represented as arrows A and B, respectively. A biasing member 288 has a first end 290 that is coupled to frame side member 172 and a second end 292 that is coupled to main body 242 of stop link 240 such that stop link 240 is biased to rotate in the direction of arrow B. In the exemplary embodiment, biasing member 288 is a coil spring.

Figure 8:
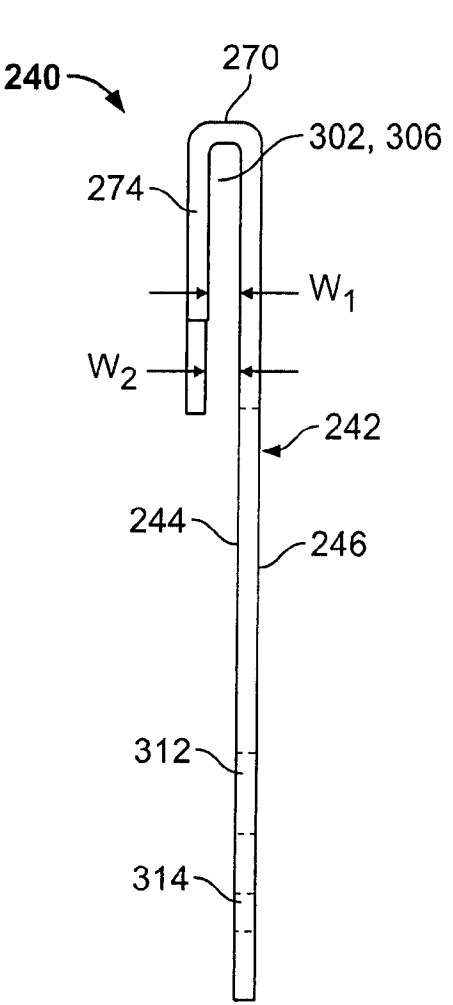
FIG. 8 is an end view of the stop link shown in FIG. 7.
Figure 7:
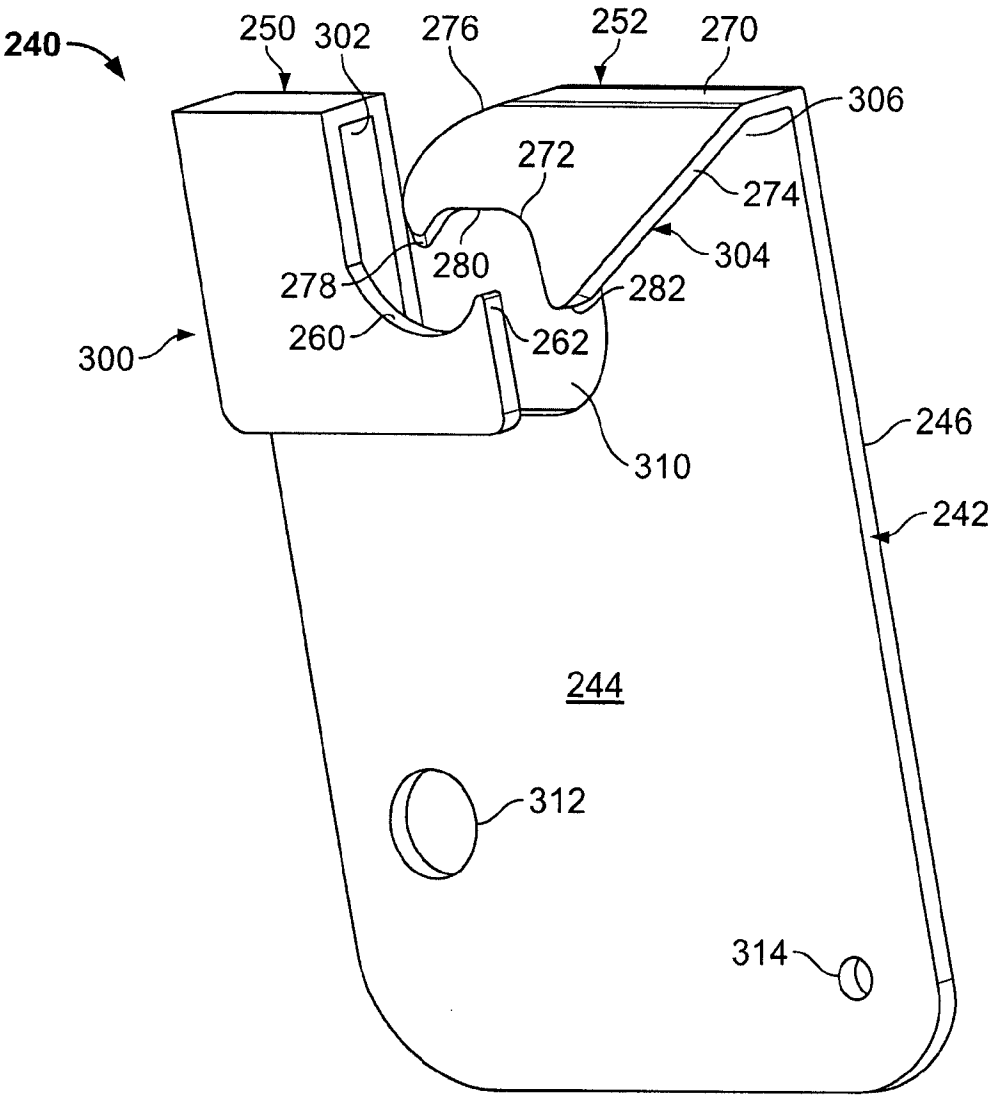
FIG. 7 is a perspective view of a stop link shown in FIG. 5.

FIG. 7 is a perspective view of stop link 240. FIG. 8 is an end view of stop link 240. A folded-over portion 300 of stop tab 250 includes stop edge 260 and defines a gap 302 that is formed between folded-over portion 300 and main body 242. In a similar manner, a second folded-over-portion 304 includes locking pocket 272 and release ramp 274 and defines a gap 306 formed between second folded-over portion 304 and main body 242. In the exemplary embodiment, folded over portions 300 and 304 are substantially coplanar with one another such that gaps 302 and 306 have inner widths $W_1$ and $W_2$, respectively, that are substantially equal to one another. Widths $W_1$ and $W_2$ are sized to receive at least a thickness of frame side member 172 (FIG. 6). Stud 266 on front link 182 has a length (not shown) such that stud 266 extends sufficiently into gaps 302 and 306 so that stud 266 may be engaged by stop edge 260 and locking pocket 272, and release ramp 274. However, stud 266 does not extend beyond outer side 244 of stop link main body 242. In some embodiments, main body 242 may include a cutout 310 between stop tab 250 and locking tab 252. Main body 242 defines a mounting hole 312 for pivotal attachment to frame side member 272, and a second hole 314 for attachment of biasing member 288.

In operation, and with reference to FIGS. 5 and 6, lower rack 132 is first fully withdrawn from wash chamber 106, as shown in FIG. 3. The user then lifts upwardly on basket handle 190 to lift frame 170 and lower rack 132. In the description that follows, it is to be understood that frame 170 and lower rack 132 move vertically in unison and references to vertical movement of either includes similar movement of the other. As lower rack 132 is raised, front link 182 rotates about attachment point 224 in a direction represented as arrow C. As lower rack 132 is raised, stud 266 on front link 182 engages upper engagement surface 270 on locking tab 252. Upon continued raising of lower rack 132 and rotation of front link 182, stud 266 causes stop link 240 to rotate in the direction of arrow A to increase a tension in biasing member 288. Stud 266 slides along arcuate edge 276 and when stud 266 passes tip 278, stop link 240 snaps back in the direction of arrow B so that stop edge 260 catches stud 266 to stop or limit upward movement of lower rack 132. When the user relaxes his or her grip on handle 190, stop link 240 begins to rotate in the direction of arrow B whereupon stud 266 is captured by lower edge 280 and retained in locking pocket 272 of locking tab 252. Lower rack 132 is locked in the elevated position for loading or unloading items.

From the elevated position, when the user again raises lower rack 132, front link 182 moves in the direction of arrow C sufficiently to allow stud 266 to clear lower release tip 282 whereupon lower rack 132 is released and may be lowered. As lower rack 132 is lowered, stud 266 slides along release ramp 274. As stud 266 slides along release ramp 274, biasing member 288 causes stop link 240 to rotate in the direction of arrow B. When stud 266 passes release ramp 274, stop link 240 snaps back to its original starting position to reset lock-and-release mechanism 200. Front link 182 rotates in a direction represented as arrow D as lower rack 132 is returned to the lowered position.

The above-described embodiments of a dishwasher rack lift system facilitate raising and locking the lower rack of the dishwasher in an elevated position. With the dishwasher lower rack raised and locked in the elevated position, loading items into and/or unloading items from the lower rack is more easily accomplished. Raising and lowering of the lower rack is accomplished by simply lifting upwardly on the lower rack handle.

While the invention has been described in terms of various specific embodiments, those skilled in the art will recognize that the invention can be practiced with modification within the spirit and scope of the claims.

What is claimed is:

1. A dishwasher comprising:

a cabinet;

a tub mounted within said cabinet, said tub defining a wash chamber;

a rack support coupled to a side wall of said tub; and a lower rack supported by said rack support such that said lower rack is movable between a retracted position within said wash chamber and an extended position wherein said lower rack extends from said wash chamber, said lower rack is movable within a range between a lowered position and an elevated position with said lower rack extended from said wash chamber;

wherein said rack support further comprises a frame and a linkage system that interconnects said frame to said side wall, said lower rack supported by said frame, said linkage system comprising:

a first linkage assembly comprising a first front link and a first rear link;

a second linkage assembly comprising a second front link and a second rear link, said first linkage assembly and said second linkage assembly positioned on opposite sides of said lower rack; and a stabilizing bar coupling said first rear link to said second rear link; and a lock-and-release mechanism configured to lock said frame in the elevated position and to release said frame from a locked condition, said lock-and-release mechanism comprising a stop link rotatable coupled to a corresponding side member of said frame, said stop link forming a stop tab and a locking tab, and at least one of said first front link and said second front link comprising a stud, said locking tab configured to engage said stud to lock said lower rack in the elevated position.

2. A dishwasher in accordance with claim 1 wherein said frame further comprises a slide mechanism supporting said lower rack, said slide mechanism comprising an outer rail fixedly coupled to said frame and an inner rail extendable from said outer rail, said inner rail supporting said lower rack.

3. A dishwasher in accordance with claim 1 wherein said rack support further comprises a lock-and-release mechanism configured to lock said frame in said elevated position and to release said frame from said locked condition.

4. A dishwasher in accordance with claim 1 wherein said rack support further comprises a biasing member configured to counterbalance said rack support and said lower rack.

5. A dishwasher in accordance with claim 1 wherein said rack support further comprises a damping element configured to dampen movement of said lower rack.

6. A rack support system for a lower rack in a dishwasher, the dishwasher defining a wash chamber within a tub, said rack support system comprising:

a frame configured to support the lower rack; and a linkage system that couples said frame to a side wall of the tub such that the lower rack is movable between a retracted position within the wash chamber and an extended position wherein the lower rack extends from the wash chamber, the lower rack is movable within a range between a lowered position and an elevated position with the lower rack extended from the wash chamber, said linkage system comprising:

a first linkage assembly comprising a first front link and a first rear link;

a second linkage assembly comprising a second front link and a second rear link, said first linkage assembly and said second linkage assembly positioned on opposite sides of the lower rack; and a stabilizing bar coupling said first rear link to said second rear link; and a lock-and-release mechanism configured to lock said frame in the elevated position and to release said frame from a locked condition, said lock-and-release mechanism comprising a stop link rotatable coupled to a corresponding side member of said frame, said stop link forming a stop tab and a locking tab, and at least one of said first front link and said second front link comprising a stud, said locking tab configured to engage said stud to lock said lower rack in the elevated position.

7. A rack support system in accordance with claim 6 wherein said frame further comprises a slide mechanism supporting the lower rack.

8. A rack support system in accordance with claim 7 wherein said slide mechanism further comprises an outer rail fixedly coupled to said frame and an inner rail extendable from said outer rail, said inner rail supporting the lower rack.

9. A rack support system in accordance with claim 6 wherein said stop link is rotatable with respect to said corresponding side member such that said stud is captured and retained within a locking pocket formed by said locking tab to lock said lower rack in the elevated position.

10. A rack support system in accordance with claim 9 wherein said first front link and said second front link are movable such that said stud is disengaged from said locking tab to release said lower rack.

11. A rack support system in accordance with claim 6 further comprising a biasing member configured to counterbalance said rack support system and the lower rack.

12. A rack support system in accordance with claim 6 further comprising a damping element configured to dampen movement of the lower rack.

* * * * *